United States Patent [19]

Durham

[11] Patent Number: 4,865,983

[45] Date of Patent: Sep. 12, 1989

[54] CLEANING COMPOSITIONS CONTAINING PROTEASE PRODUCED BY VIBRIO AND METHOD OF USE

[75] Inventor: Donald R. Durham, Gaithersburg, Md.

[73] Assignee: W. R. Grace & Co.-Conn., New York, N.Y.

[21] Appl. No.: 129,016

[22] Filed: Dec. 4, 1987

[51] Int. Cl.[4] ..... D06M 16/00

[52] U.S. Cl. ..... 435/264; 252/174.12; 252/DIG. 12; 252/103; 435/220; 435/262; 435/263; 435/909

[58] Field of Search ..... 435/909, 262–264; 252/174.12, DIG. 12

[56] References Cited

U.S. PATENT DOCUMENTS

| | | | |
|---|---|---|---|
| Re. 30,602 | 5/1981 | TeNijenhuis | 252/99 |
| 3,553,139 | 1/1971 | McCarty | 252/95 |
| 3,674,643 | 7/1972 | Aunstrup et al. | 195/62 |
| 3,697,451 | 10/1972 | Maemer et al. | 252/545 |
| 3,748,233 | 7/1973 | Viccaro | 195/66 R |
| 3,790,482 | 2/1974 | Jones et al. | 252/525 |
| 3,827,938 | 8/1974 | Aunstrup et al. | 195/62 |
| 3,871,963 | 3/1975 | Tobe et al. | 195/62 |
| 3,931,033 | 1/1976 | Lohr et al. | 252/122 |
| 4,162,987 | 7/1979 | Maguire et al. | 252/135 |
| 4,169,817 | 2/1979 | Weber | 252/545 |
| 4,287,101 | 9/1981 | Nishio et al. | 252/537 |
| 4,429,044 | 1/1985 | Boguslawski et al. | 435/220 |
| 4,480,037 | 10/1984 | Ichishima et al. | 435/221 |
| 4,511,490 | 4/1985 | Stanislowski et al. | 252/174.12 |
| 4,515,705 | 5/1985 | Moeddel | 252/174.12 |
| 4,543,333 | 9/1985 | Eilertsen | 435/188 |

FOREIGN PATENT DOCUMENTS

| | | |
|---|---|---|
| 0130756 | 1/1985 | European Pat. Off. . |
| WO87/04461 | 7/1987 | PCT Int'l Appl. . |

OTHER PUBLICATIONS

Litchfield et al.–Chem. Abst., vol. 82 (1975), p. 39206q.
Deane et al.–Chem. Abst. vol. 104 (1986), p. 203594k.
Car et al.–Chem. Abst., vol. 102 (1985), p. 41675s.
Wilkes et al, *Methods in Enzymology,* vol. 45, pp. 404–415 (1976).
Crueger et al, *Biotechnology; A Textbook of Industrial Microbiology,* pp. 175–176 (Science Tech).
*Innovations in Biotechnology,* Edited by E. H. Houwink & R. R. van der Meer, pp. 31–52 (Elsevier Science Publishers, 1984).
*J. Biological Chemistry,* vol. 260, No. 11, pp. 6518–6521 (1985).
*Biotechnology and Bioengineering,* Vol. XII, pp. 179–212 (1970).
*Trends in Biotechnology,* vol. 3, No. 3, pp. 68–72 (1985).

*Primary Examiner*—Sam Rosen
*Attorney, Agent, or Firm*—Steven T. Trinker

[57] ABSTRACT

Cleaning compositions containing an extracellular protease produced by a microorganism of the genus Vibrio are provided. Such enzymes are characterized by a high proteolytic activity, stability over wide pH and tmperature ranges and excellent stability to oxidizing agents, including a unique stability to chlorine bleaches, and are well-suited for formulation into laundry detergents, automatic dishwasher detergents, laundry bleaches, pre-soaks, as well as other types of cleaning compositions.

18 Claims, 12 Drawing Sheets

FIG. 1 (Page 1 of 5)

```
TTATATATTTGTTAATTAAATATAACGCAATGAATTAATTAAAAAAAATTATTGTTTACTCTATAAAATAACATGGATTAATTTTATAGAATGTCAACTC   100
AATATATAAACAATTAATTTATATTGCGTTACTTAATTAATTTTTTTTAATAACAAATGAGATATTTTATTGTACCTAATTAAAATATCTTACAGTTGAG
 i  y  l  l  i  k  y  n  a  m  n  .  l  k  k  i  i  v  y  s  i  k  .  h  g  l  i  l  .  n  v  n  s

TAATTGACGTGGGATATAAAATATTTTTCTTACAAACTGGAATGTTACAGAAATGTAATTAATGGTTATTTCGCGAGTTATCGCAGGAGGGTTTAATTTC   200
ATTAACTGCACCCTATATTTTATAAAAAGAATGTTTGACCTTACAATGTCTTTACATTAATTACCAATAAAGCGCTCAATAGCGTCCTCCCAAATTAAAG
 n  .  r  g  i  .  n  i  f  l  t  n  w  n  v  t  e  m  .  l  m  v  i  s  r  v  i  a  g  g  f  n  f

TGATTTATCAGTAGTTAAACAACGATTGAAAATAATCTCCAGGATTGAGAAATGAATAAAACACAACGTCACATCAACTGGCTGCTGGCTGTTAGCGCGG   300
ACTAAATAGTCATCAATTTGTTGCTAACTTTTATTAGAGGTCCTAACTCTTTACTTATTTTGTGTTGCAGTGTAGTTGACCGACGACCGACAATCGCGCC
 .  f  i  s  s  .  t  t  i  e  n  n  l  q  d  .  e  m  n  k  t  q  r  h  i  n  w  l  l  a  v  s  a  a

CAACTGCGCTACCTGTCACCGCTGCAGAAATGATCAACGTAAATGATGGCAGCCTGCTAAACCAGGCTCTTAAAGCTCAGTCACAGAGCGTTGCCCCGGT   400
GTTGACGCGATGGACAGTGGCGACGTCTTTACTAGTTGCATTTACTACCGTCGGACGATTTGGTCCGAGAATTTCGAGTCAGTGTCTCGCAACGGGGCCA
 t  a  l  p  v  t  a  a  e  m  i  n  v  n  d  g  s  l  l  n  q  a  l  k  a  q  s  q  s  v  a  p  v

GGAAACCGGATTCAAACAAATGAAACGAGTTGTTTTGCCAAATGGCAAAGTGAAAGTTCGTTATCAACAAACTCACCACGGTCTACCGGTTTTCAACACC   500
CCTTTGGCCTAAGTTTGTTTACTTTGCTCAACAAAACGGTTTACCGTTTCACTTTCAAGCAATAGTTGTTTGAGTGGTGCCAGATGGCCAAAAGTTGTGG
 e  t  g  f  k  q  m  k  r  v  v  l  p  n  g  k  v  k  v  r  y  q  q  t  h  h  g  l  p  v  f  n  t
```

FIG. 1 (Page 2 of 5)

```
TCGGTAGTGGCGACTGAATCGAAGTCTGGTAGTAGCGAAGTGTTCGGTGTGATGGCTCAGGGTATCGCAGACGACGTGTCTACACTGACGCCATCCGTTG
----.----+----.----+----.----+----.----+----.----+----.----+----.----+----.----+----.----+----.----+
AGCCATCACCGCTGACTTAGCTTCAGACCATCATCGCTTCACAAGCCACACTACCGAGTCCCATAGCGTCTGCTGCACAGATGTGACTGCGGTAGGCAAC   600

s  v  v  a  t  e  s  k  s  g  s  s  e  v  f  g  v  m  a  q  g  i  a  d  d  v  s  t  l  t  p  s  v  e
----.----+----.----+----.----+----.----+----.----+----.----+----.----+----.----+----.----+----.----+

AGATGAAGCAGGCCATTTCAATTGCTAAATCGCGTTTCCAACAGCAAGAAAAAATGGTTGCGGAACCTGCAACGGAAAACGAAAAAGCCGAGTTGATGGT
----.----+----.----+----.----+----.----+----.----+----.----+----.----+----.----+----.----+----.----+
TCTACTTCGTCCGGTAAAGTTAACGATTTAGCGCAAAGGTTGTCGTTCTTTTTTACCAACGCCTTGGACGTTGCCTTTTGCTTTTTCGGCTCAACTACCA   700

 m  k  q  a  i  s  i  a  k  s  r  f  q  q  q  e  k  m  v  a  e  p  a  t  e  n  e  k  a  e  l  m  v
----.----+----.----+----.----+----.----+----.----+----.----+----.----+----.----+----.----+----.----+

TCGTCTGGACGACAACAATCAAGCGCAACTAGTGTATCTGGTTGATTTCTTCGTTGCCGAGGATCACCCAGCGCGTCCTTTCTTTTTCATTGATGCGCAA
----.----+----.----+----.----+----.----+----.----+----.----+----.----+----.----+----.----+----.----+
AGCAGACCTGCTGTTGTTAGTTCGCGTTGATCACATAGACCAACTAAAGAAGCAACGGCTCCTAGTGGGTCGCGCAGGAAAGAAAAAGTAACTACGCGTT   800

 r  l  d  d  n  n  q  a  q  l  v  y  l  v  d  f  f  v  a  e  d  h  p  a  r  p  f  f  f  i  d  a  q
----.----+----.----+----.----+----.----+----.----+----.----+----.----+----.----+----.----+----.----+

ACGGGTGAAGTACTGCAAACTTGGGATGGTCTGAACCATGCACAAGCTGACGGTACTGGCCCTGGCGGTAACACCAAAACAGGTCGTTATGAATACGGTT
----.----+----.----+----.----+----.----+----.----+----.----+----.----+----.----+----.----+----.----+
TGCCCACTTCATGACGTTTGAACCCTACCAGACTTGGTACGTGTTCGACTGCCATGACCGGGACCGCCATTGTGGTTTTGTCCAGCAATACTTATGCCAA   900

t  g  e  v  l  q  t  w  d  g  l  n  h  a  q  a  d  g  t  g  p  g  g  n  t  k  t  g  r  y  e  y  g  s
----.----+----.----+----.----+----.----+----.----+----.----+----.----+----.----+----.----+----.----+

CTGACTTTCCTCCGTTTGTCATCGATAAAGTCGGCACTAAGTGTTCAATGAACAACAGCGCGGTAAGAACGGTTGACCTGAACGGCTCAACTTCAGGTAA
----.----+----.----+----.----+----.----+----.----+----.----+----.----+----.----+----.----+----.----+
GACTGAAAGGAGGCAAACAGTAGCTATTTCAGCCGTGATTCACAAGTTACTTGTTGTCGCGCCATTCTTGCCAACTGGACTTGCCGAGTTGAAGTCCATT   1000

 d  f  p  p  f  v  i  d  k  v  g  t  k  c  s  m  n  n  s  a  v  r  t  v  d  l  n  g  s  t  s  g  n
----.----+----.----+----.----+----.----+----.----+----.----+----.----+----.----+----.----+----.----+
```

FIG. 1 (Page 3 of 5)

```
CACCACTTACAGCTATACCTGTAACGACTCAACCAACTACAACGATTACAAAGCCATTAACGGCGCGTACTCGCCACTGAACGATGCCCACTACTTCGGT
GTGGTGAATGTCGATATGGACATTGCTGAGTTGGTTGATGTTGCTAATGTTTCGGTAATTGCCGCGCATGAGCGGTGACTTGCTACGGGTGATGAAGCCA   1100

 t  t  y  s  y  t  c  n  d  s  t  n  y  n  d  y  k  a  i  n  g  a  y  s  p  l  n  d  a  h  y  f  g

AAAGTGGTTTTCGATATGTACAAAGACTGGATGAACACCACACCACTGACGTTCCAGCTGACTATGCGTGTTCACTATGGTAACAACTACGAAAACGCGT
TTTCACCAAAAGCTATACATGTTTCTGACCTACTTGTGGTGTGGTGACTGCAAGGTCGACTGATACGCACAAGTGATACCATTGTTGATGCTTTTGCGCA   1200

k  v  v  f  d  m  y  k  d  w  m  n  t  t  p  l  t  f  q  l  t  m  r  v  h  y  g  n  n  y  e  n  a  f

TCTGGAATGGTTCATCCATGACCTTCGGTGATGGCTACAGCACCTTCTACCCGCTGGTGGATATTAACGTTAGTGCCCACGAAGTGAGCCACGGTTTCAC
AGACCTTACCAAGTAGGTACTGGAAGCCACTACCGATGTCGTGGAAGATGGGCGACCACCTATAATTGCAATCACGGGTGCTTCACTCGGTGCCAAAGTG   1300

 w  n  g  s  s  m  t  f  g  d  g  y  s  t  f  y  p  l  v  d  i  n  v  s  a  h  e  v  s  h  g  f  t

CGAACAAAACTCGGGTCTGGTGTACGAGAATATGTCTGGTGGTATGAACGAAGCGTTCTCTGATATTGCAGGTGAAGCAGCAGAGTTCTACATGAAAGGC
GCTTGTTTTGAGCCCAGACCACATGCTCTTATACAGACCACCATACTTGCTTCGCAAGAGACTATAACGTCCACTTCGTCGTCTCAAGATGTACTTTCCG   1400

 e  q  n  s  g  l  v  y  e  n  m  s  g  g  m  n  e  a  f  s  d  i  a  g  e  a  a  e  f  y  m  k  g

AGCGTTGACTGGGTTGTCGGTGCGGATATCTTCAAATCATCCGGCGGTCTGCGTTACTTTGATCAGCCTTCGCGTGACGGCCGTTCTATCGACCATGCGT
TCGCAACTGACCCAACAGCCACGCCTATAGAAGTTTAGTAGGCCGCCAGACGCAATGAAACTAGTCGGAAGCGCACTGCCGGCAAGATAGCTGGTACGCA   1500

s  v  d  w  v  v  g  a  d  i  f  k  s  s  g  g  l  r  y  f  d  q  p  s  r  d  g  r  s  i  d  h  a  s
```

FIG. 1 (Page 4 of 5)

```
CTGACTACTACAATGGCCTGAATGTTCACTACTCAAGTGGTGTATTCAACCGTGCGTTCTACCTGCTGGCTAACAAAGCGGGTTGGGATGTACGCAAAGG
----.----+----.----+----.----+----.----+----.----+----.----+----.----+----.----+----.----+----.----+----.----+ 1600
GACTGATGATGTTACCGGACTTACAAGTGATGAGTTCACCACATAAGTTGGCACGCAAGATGGACGACCGATTGTTTCGCCCAACCCTACATGCGTTTCC

 d  y  y  n  g  l  n  v  h  y  s  s  g  v  f  n  r  a  f  y  l  l  a  n  k  a  g  w  d  v  r  k  g
----.----+----.----+----.----+----.----+----.----+----.----+----.----+----.----+----.----+----.----+

CTTTGAAGTGTTTACCCTGGCTAACCAATTGTACTGGACAGCGAACAGCACATTTGATGAAGGCGGTTGTGGTGTAGTGAAAGCTGCGAGCGACATGGGT
----.----+----.----+----.----+----.----+----.----+----.----+----.----+----.----+----.----+----.----+----.----+ 1700
GAAACTTCACAAATGGGACCGATTGGTTAACATGACCTGTCGCTTGTCGTGTAAACTACTTCCGCCAACACCACATCACTTTCGACGCTCGCTGTACCCA

 f  e  v  f  t  l  a  n  q  l  y  w  t  a  n  s  t  f  d  e  g  g  c  g  v  v  k  a  a  s  d  m  g
----.----+----.----+----.----+----.----+----.----+----.----+----.----+----.----+----.----+----.----+

TACAGCGTTGCAGACGTAGAAGATGCGTTTAACACGGTAGGCGTTAACGCGTCTTGTGGTGCAACTCCTCCTCCGTCTGGCGATGTACTGGAAATCGGTA
----.----+----.----+----.----+----.----+----.----+----.----+----.----+----.----+----.----+----.----+----.----+ 1800
ATGTCGCAACGTCTGCATCTTCTACGCAAATTGTGCCATCCGCAATTGCGCAGAACACCACGTTGAGGAGGAGGCAGACCGCTACATGACCTTTAGCCAT

y  s  v  a  d  v  e  d  a  f  n  t  v  g  v  n  a  s  c  g  a  t  p  p  p  s  g  d  v  l  e  i  g  k
----.----+----.----+----.----+----.----+----.----+----.----+----.----+----.----+----.----+----.----+

AACCGCTGGCGAACCTTTCAGGTAACCGCAATGACATGACTTACTACACGTTCACACCAAGCAGCTCATCTAGCGTAGTGATTAAGATCACTGGCGGTAC
----.----+----.----+----.----+----.----+----.----+----.----+----.----+----.----+----.----+----.----+----.----+ 1900
TTGGCGACCGCTTGGAAAGTCCATTGGCGTTACTGTACTGAATGATGTGCAAGTGTGGTTCGTCGAGTAGATCGCATCACTAATTCTAGTGACCGCCATG

 p  l  a  n  l  s  g  n  r  n  d  m  t  y  y  t  f  t  p  s  s  s  s  s  v  v  i  k  i  t  g  g  t
----.----+----.----+----.----+----.----+----.----+----.----+----.----+----.----+----.----+----.----+

AGGTGATGCAGACCTTTACGTGAAAGCGGGTAGCAAGCCAACCACGACTTCTTACGATTGCCGTCCATATAAGTATGGTAACGAAGAGCAGTGTTCAATT
----.----+----.----+----.----+----.----+----.----+----.----+----.----+----.----+----.----+----.----+----.----+ 2000
TCCACTACGTCTGGAAATGCACTTTCGCCCATCGTTCGGTTGGTGCTGAAGAATGCTAACGGCAGGTATATTCATACCATTGCTTCTCGTCACAAGTTAA

 g  d  a  d  l  y  v  k  a  g  s  k  p  t  t  t  s  y  d  c  r  p  y  k  y  g  n  e  e  q  c  s  i
----.----+----.----+----.----+----.----+----.----+----.----+----.----+----.----+----.----+----.----+
```

FIG. 1 (Page 5 of 5)

```
TCAGCGCAAGCGGGTACTACGTATCACGTTATGCTGCGTGGTTACAGCAATTACGCTGGTGTAACTTTGCGTGCTGACTAAACTCAGAATGGAACCAGTG
AGTCGCGTTCGCCCATGATGCATAGTGCAATACGACGCACCAATGTCGTTAATGCGACCACATTGAAACGCACGACTGATTTGAGTCTTACCTTGGTCAC   2100
s a q a g t t y h v m l r g y s n y a g v t l r a d . t q n g t s e

AAGGCGCACCTTAAGGTCGCCTTTTTTGTATCAGGCGATCTGTGTAAACGTGACCTGATCGAAGTGAGGATTGGCCGCCAGCGCTTGCATGCTGTGTAAG
TTCCGCGTGGAATTCCAGCGGAAAAAACATAGTCCGCTAGACACATTTGCACTGGACTAGCTTCACTCCTAACCGGCGGTCGCGAACGTACGACACATTC   2200
 g a p . g r l f c i r r s v . t . p d r s e d w p p a l a c c v r

GACTCGGTGGGCAACGTCTCATGGCCACTGGATGTCGCAATGACGATGGCCTCTTTTCGTTCTGTGGTGTATGTTGTATCGACCGCCGTCCCTTCCACAA
CTGAGCCACCCGTTGCAGAGTACCGGTGACCTACAGCGTTACTGCTACCGGAGAAAAGCAAGACACCACATACAACATAGCTGGCGGCAGGGAAGGTGTT   2300
t r w a t s h g h w m s q . r w p l f v l w c m l y r p p s l p q

TCGTGCCGTTGAGCAGTTTGAGTCTGACTGGCAGGTGATAAAGGCAGGCAATCTCGATGTAATCGTACTGGCTGCAG
AGCACGGCAACTCGTCAAACTCAGACTGACCGTCCACTATTTCCGTCCGTTAGAGCTACATTAGCATGACCGACGTC   2377
s c r . a v . v . l a g d k g r q s r c n r t g c s
```

CLEANING COMPOSITIONS CONTAINING PROTEASE PRODUCED BY VIBRIO AND METHOD OF USE

BACKGROUND OF THE INVENTION

The present invention relates to cleaning compositions, and to a method of cleaning using such compositions, which contain certain proteases produced by microorganisms of the genus Vibrio. It particularly relates to laundry detergents, bleaches, automatic dishwasher detergents, and laundry pre-soak compositions which contain such Vibrio proteases.

Protease-containing cleaning compositions are well known in the art. Such compositions are commercially available, and are described in a large body of art. Representative of this literature are U.S. Pat. Nos. Re. 30,602; 3,553,139; 3,674,643; 3,697,451; 3,748,233; 3,790,482; 3,827,938; 3,871,963; 3,931,034; 4,162,987; 4,169,817; 4,287,101; 4,429,044; 4,480,037; 4,511,490, 4,515,705 and 4,543,333; as well as *Innovations in Biotechnology,* edited by E. H. Houwink and R. R. van der Meer, pages 31 to 52 (Elsevier Science Publishers, Amsterdam, 1984).

A major trend in the detergent industry is for manufacturers to develop phosphate-free products that function at low wash temperatures. In addition, liquid laundry detergents are increasingly popular with consumers. As a result of these changes in the formulation of detergent compositions, detergent makers have increasingly turned to the use of enzymes in order to compensate for reductions in cleaning power.

In order to be useful as a detergent enzyme, it is desirable for a protease to possess high activity on proteinaceous substances over a wide pH and temperature range; good alkaline stability; stability in the presence of surfactants, builders, oxidizing agents and other detergent components; and good storage (shelf-life) stability. The need for stability in the presence of other detergent components has become particularly important with the evolution of multifunctional products which contain, e.g., built-in bleaches, fabric softeners, etc.

The most widely employed proteases in cleaning compositions are the alkaline proteases derived from various strains of Bacillus. Such proteases, which are marketed under tradenames such as and Esperase TM and Alcalase TM from Novo Laboratories, Wilton, Conn. and Maxatase TM and Maxacal TM from Gist-Brocades, Chattanooga, Tenn., have desirable alkaline stability properties and proteolytic activities. The temperature optima of these enzymes, however, is about 60°-70° C., which is above the normal temperatures used for warm (30°-40° C.) and cool (15°-30 + C.) water washings. Moreover, the Bacillus alkaline proteases have less than desirable stability to oxidizing agents, and are completely unstable in chlorine bleaches, which precludes their use with chlorine bleaches, automatic dishwasher detergents, etc.

As a result of these deficiencies in the properties of the Bacillus alkaline proteases, the art has attempted to develop alternative alkaline proteases such as the alkaline serine protease produced by *Flavobacterium arborescens,* described in U.S. Pat. No. 4,429,044. Another approach to this problem has been to modify the known Bacillus alkaline proteases, using recombinant DNA technology and site-directed mutagenesis, to improve the stability of the enzymes. In this regard, see, e.g., Estell et al., *J. Biological Chemistry,* Vol. 260, No. 11, pages 6518-6521, (1985); European Published Patent Application No. 130 756, dated Jan. 9, 1985; and PCT Published Application No. WO 87/04461, dated July 30, 1987.

It has also been suggested that various neutral proteases may be employed in detergent applications. *See,* e.g., U.S. Pat. No. 4,511,490; Cowan et al., *Trends in Biotechnology,* Vol. 3, No. 3, pages 68-72 (1985); and Keay et al., *Biotechnology and Bioengineering,* Vol. XII, pages 179-212 (1970). However, as indicated by the latter two articles, the neutral proteases which have heretofore been tested in detergent applications have reduced activities at the alkaline pH values normally present during detergent use, and poor stability to oxidizing agents.

In addition to the various enzymes discussed above, a multitude of different proteases are known for use in other (i.e., non-detergent) applications. Commonly assigned, co-pending U.S. patent application Ser. No. 83,741, filed Aug. 7, 1987, for example, describes the use of a protease produced by *Vibrio proteolyticus* (ATCC 53559) (hereinafter referred to as "vibriolysin") to mediate peptide bond formation. A large number of various other proteases and their respective utilities are also described in Cowan et al., *Trends in Biotechnology,* Vol. 3, No. 3, pages 68-72 (1985). Despite the existence of this multitude of known proteases, recombinant DNA technology, etc., however, the prior art has yet to develop proteases completely satisfactory for use in modern cleaning formulations.

SUMMARY OF THE INVENTION

In accordance with the present invention, there has been provided cleaning compositions comprising at least one material selected from the group consisting of builders, bleaching agents, detergents and mixtures thereof; and in an amount effective to enhance removal of protein-containing materials, a protease selected from the group consisting of:

(a) extracellular proteases produced by cultivation of a microorganism belonging to the genus Vibrio characterized by:
   i. a cool water (25° C.) specific activity of at least 30 azocasein units/mg of protease at pH 8.2;
   ii. a specific activity (Delft method) of at least 3,000 Delft units/mg of protease;
   iii. an optimum proteolytic activity at a pH in the range of from about pH 6.5 to pH 9.0; and
   iv. a stable activity over a pH range of pH 6.5 to pH 11.0;

(b) proteases expressed by recombinant host cells which have been transformed or transfected with an expression vector for said protease (a); and (c) mutants and hybrids of proteases (a) and (b) which retain the performance characteristics thereof, i.e., which satisfy the performance characteristics (i) to (iv) above.

While not wishing to be bound by any particular theory or mode of operation, it has been discovered that certain extracellular proteases produced by cultivation of microorganisms of the genus Vibrio possess a high proteolytic activity, stability over wide pH and temperature ranges and excellent stability to oxidizing agents, including a unique stability to chlorine bleaches. The combination of these properties makes such proteases well-suited for formulation into laundry detergents, automatic dishwasher detergents, laundry bleaches, pre-soaks, as well as various other types of cleaning compositions. Indeed, it has been found that vibriolysin, an extracellular protease excreted by *Vibrio proteolyticus* (ATC 53559) is three to four times more active than the most widely used detergent protease, subtilisin Carlsberg, between pH 6 to 9 at 25° C. Moreover, at temperatures of 40°–50° C. vibriolysin exhibits an approximately two-fold longer life in most commercial detergent formulations than subtilisin Carlsberg, and improved stability to oxidizing agents. These properties make vibriolysin, as well as the various other Vibrio proteases within the scope of this invention, ideally suited for use in e.g., laundry detergents designed for cool and warm water washing and liquid laundry detergents, as well as in various other types of cleaning compositions.

In other aspects of this invention, laundry detergent, automatic dishwasher detergent and laundry bleach formulations are thus provided. Also provided are methods of cleaning which comprise contacting a substrate with a solution containing a cleaning effective amount of such Vibrio protease-containing formulations, as well as a method for removing protein deposits from a substrate which comprises contacting the substrate with a solution containing an effective amount of a Vibrio protease.

Other embodiments, features and advantages of the present invention will become apparent to those skilled in the art upon examination of the following detailed description of the invention and accompanying drawings.

BRIEF DESCRIPTION OF THE DRAWINGS

FIG. 1 (2 pages) is a representation of the DNA sequence of the vibriolysin gene. The DNA sequence illustrated comprises a portion of a 6.7 Kb Hind III fragment of the *Vibro proteolyticus* gene (described in copending U.S. patent application Ser. No. 103,983, filed Oct. 1, 1987) which encodes vibriolysin. An open reading frame exists from approximately base #249–2078, within which the DNA region encoding vibriolysin is found.

DETAILED DESCRIPTION OF THE INVENTION

Figure 2:
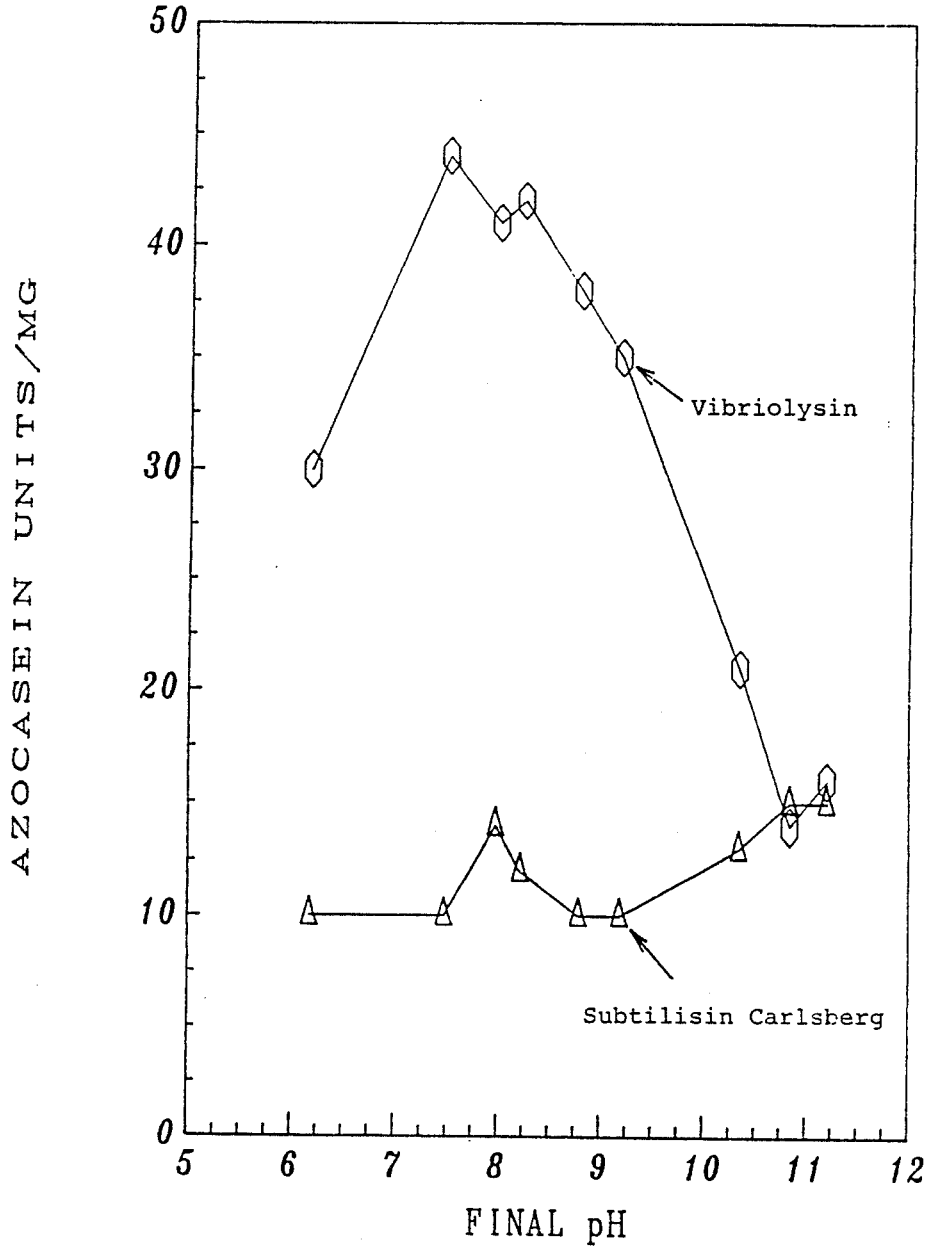
FIG. 2 is a graphical comparison of the specific activities of vibriolysin and subtilisin Carlsberg as a function of pH at 25° C.

The proteases of this invention are produced by fermentation of a suitable Vibrio species in a nutrient medium and then recovering the protease from the resulting broth. Fermentation is conducted aerobically in, for example, a polypeptone or soya flour nutrient medium containing inorganic salts such as sea salts, sodium sulfate, potassium dihydrogen phosphate, magnesium sulfate and certain trace elements at a pH of from about 8.0 to 8.6, preferably from about pH 8.4 to 8.6, and at a temperature of from about 25° to 30° C., e.g., about 27° C., until the optical density peaks at about 10–12 O.D. at 640 nm after about 10 to 15 hours.

The enzyme may thereafter be recovered from the fermentation broth by conventional procedures. Typically, the broth is first centrifuged or filtered to separate the cell portion and insoluble material. Thereafter, the supernatant is concentrated by, e.g., ultrafiltration. The resulting ultrafiltrate may be used as is for liquid cleaning compositions, such as, for example, liquid laundry or automatic dishwasher detergents, or may be precipitated with organic solvents such as acetone or inorganic salts such as ammonium sulfate, followed by centrifugation, ion-exchange chromatography or filtration in order to isolate an enzyme useful in powdered cleaning compositions. Other procedures such as are routine to those skilled in the art may also be used to cultivate the Vibrio microorganism and to recover the protease of this invention therefrom.

The proteases of this invention are characterized by a combination of properties which renders them ideal candidates for use in cleaning compositions. By way of illustration and not limitation, such properties include:

(a) a cool water (25° C.) specific activity of at least 30 azocasein units per milligram of protease at pH 8.2;

(b) a specific activity (Delft method) of at least 3000 Delft units/mg of protease;

(c) an optimum proteolytic activity at a pH of from about 6.5 to 9.0; and (d) an activity which is stable over a range of from pH 6.5 to 11.0.

In addition, the proteases isolated to date also possess excellent stability to oxidizing agents, including a unique stability to chlorine-releasing oxidizing agents, and to exposure to temperatures in the range of 40°–60° C.

For the purposes of this application and the appended claims, the aforementioned properties of the proteases of this invention are determined as follows:

a. Cool Water Specific Activity

A sample of protease is incubated for ten minutes at 25° C. in 50 mM Tris-HCl buffer (pH 8.2) containing 1.0 mg/ml of azocasein (sulfanilamideazocasein, Sigma Corp., St. Louis, Mo.) with a final volume of 0.5 milliliters. At the end of this incubation period, 0.5 milliliters of 10% w/v trichloroacetic acid are added and immediately mixed and the resulting mixture is then stored on ice for 10 minutes. The mixture is then centrifuged and the optical density of the resulting supernatant is determined at 420 nm against a blank that contains either no enzyme or inactivated enzyme in the buffered azocasein solution. The specific activity units of this assay (hereinafter referred to as "azocasein assay") are defined as follows:

$$\text{Azocasein units/mg} = \frac{\Delta \text{ absorbance at 420 nm}}{2.5 \times \text{mg of protease}}$$

b. Specific Activity (Delft Method)

The Delft method is described in British Patent No. 1,353,317. This procedure measures the amount of trichloroacetic acid soluble peptides released from casein during incubation with protease at 40° C., pH 8.5. Activity is expressed in Delft units/mg of protease.

c. Optimum Proteolytic Activity As A Function Of pH

This property is determined by the azocasein assay technique, by varying the pH of the protease-azocasein incubation solution over the pH range of 6.0 to 11.0 using an incubation temperature of 40° C.

d. pH Stability pH stability is determined by measuring the percent residual activity of a given protease (azocasein assay, pH 7.4, 37° C.) after incubation in a series of 0.25% sodium tripolyphosphate buffer solutions having a pH between 6.5 to 12.0 for 24 hours at 25° C. For the purposes of this invention, a given protease is considered to be pH stable over the range of pH 6.5 to 11.0 if the residual activity exhibited by the protease after incubation between pH 6.5 to 11.0 is no less than about 80% of the initial activity of the protease within this range.

e. Thermal Stability

Thermal stability is determined by measuring the percent residual activity of a given protease over time after incubation in temperature controlled 25 mM borate buffer (pH 9.0) test solutions, preincubated to temperatures ranging from 40°–70° C. Over the course of the incubation, aliquots are periodically removed from each test solution, cooled on ice, and then the activity of the protease is measured by the azocasein assay (pH 7.4, 37° C.). For the purposes of this invention, a given protease is considered to be thermally stable if the protease retains at least about 75% of its initial activity after incubation for 60 minutes at 40 to 60° C.

f. Stability to Oxidizing Agents i. chlorine-releasing oxidizing agent

A given protease is defined as being stable to chlorine-releasing oxidizing agents if the protease retains at least 75% of its initial activity after incubation in a 25 mM borate buffer solution (pH 9.0) containing 0.026% by weight aqueous sodium hypochlorite for ten minutes at 40° C., using the azocasein assay (pH 7.4, 37° C.) to determine protease activity.

ii. Hydrogen Peroxide

Same as hypochlorite stability except that the protease is incubated in a 25 mM borate buffer solution (pH 9.0) containing five percent w/v aqueous hydrogen peroxide solution.

Useful Vibrio microorganisms for use as a source of the instant proteases may comprise any suitable Vibrio species which secretes a protease having the above properties. A particularly preferred microorganism for this purpose is *Vibrio proteolyticus* (ATCC 53559). A viable culture of this microorganism has been irrevocably deposited with the American Type Culture Collection (ATCC), 12301 Parklawn Drive, Rockville, Md., 20852, with no restrictions as to availability, and W. R. Grace & Co., the assignee hereof, assures permanent availability of the culture to the public through ATCC upon the grant hereof.

The DNA sequence of the protease secreted by *Vibrio proteolyticus* (ATCC 53559), referred to herein as vibriolysin, is set forth in FIG. 1.

While *vibrio proteolyticus* (ATCC 53559) comprises the preferred protease source, other species of useful Vibrio microorganisms can readily be identified by those skilled in the art by screening the proteases produced thereby using the procedures set forth above.

In addition to the direct cultivation of a Vibrio species, the proteases of this invention may also be prepared by the cultivation of recombinant host cells which have been transformed or transfected with a suitable expression vector with an insert containing the structural gene for the Vibrio derived proteases of this invention. Such procedures may be desirable, for example, in order to increase protease yields over that obtained with the wild type Vibrio microorganism or in order to produce improved mutant proteases.

Techniques for the cloning of proteases are well known to those skilled in the art of recombinant DNA technology, and any suitable cloning procedure may be employed for the preparation of the proteases of this invention. Such procedures are described for example in U.S. Pat. No. 4,468,464; European Published Patent Application No. 0 130 756; PCT Published Patent Application No. WO 87/04461; and Loffler, Food Technology, pages 64–70 (Jan. 1986); the entirety of which are hereby incorporated by reference and relied on in their entirety.

A particularly preferred procedure for cloning the Vibrio proteases of this invention is described in commonly assigned, copending U.S. patent application Ser. No. 103,983, filed Oct. 1, 1987, the entirety of which is hereby incorporated by reference and relied on in its entirety. According to the procedure of this application, a gene library is first prepared, using the DNA of Vibrio source cells which have been determined by the assays described above to synthesize the proteases of this invention. Chromosomal DNA is extracted from the Vibrio source cells and digested with restriction enzymes by known procedures to give cleavage of the DNA into large fragments. Partial digestion with Sau 3A is preferred, although other restriction enzymes (e.g., Mbo 1, BAM H1, etc.) may be used. The DNA fragments are then ligated into vectors suitable for allowing isolation of clones which express the protease enzyme. A preferred vector for this purpose is Bam H1 digested *E. coli* cosmid vector pHC79 (Bethesda Research Laboratories). The recombinant vectors (i.e., pHC79 cosmids containing DNA fragments from the protease-containing genome) are then packaged into bacteriophage particles, preferably bacteriophage lambda, thereby producing a gene library in bacteriophage lambda particles. For production of a gene library in bacteriophage, a cosmid vector or lambda vector is used. In other cases, plasmid vectors may be used.

The resultant bacteriophage particles are then used to insert the gene library DNA fragments into suitable gram-negative host cells. Preferably, the recombinant bacteriophage particles are used to transfect *E. coli,* such as for example *E. coli* strain HB101, although other strains of *E. coli* may be used if desired. Since *E. coli* strains do not naturally synthesize am extracellar neutral protease enzyme, the *E. coli* clones easily may be evaluated for the presence and expression of the protease gene by the assays described below, particularly the milk-clearing assay.

It is known that colonies of Vibrio which synthesize protease enzyme will produce a zone of clearing on milk agar plates. Non-recombinant *E. coli* colonies do not, nor do other hosts which do not secrete a protease naturally. Clones of this invention which contain the protease gene are therefore readily identified by this assay. This milk-clearing assay is preferred for use with *E. coli* and other host strains which do not naturally produce an extracellular protease. Other gram-negative strains may be used as hosts.

Confirmation may be made by using other protease assays. For example, clones may be confirmed for expression of the protease enzyme by demonstrating that the fermentation broths of these clones are capable of hydrolyzing substrates such as Hide powder azure, azocoll or N-[3-(2-furyl)acryloyl]--alanyl-phenylalaniamide (FAAPA). Alternatively, these assays may be used in the first instance to identify the protease gene-containing clones.

It is significant in two respects that expression of the neutral protease gene in *E. coli* and other "non-secreting" hosts (that is, hosts which do not naturally secrete a protease) can be detected as a zone of clearing on a milk agar plate. First, this is evidence that the active, functional enzyme is being synthesized by the gram-negative host. Second, the extracellular presence of protease on the milk agar plates is evidence that the enzyme is being externalized in some manner, either by secretion or by cell lysis. Since *E. coli* and some other gram-negative bacteria normally do not secrete significant quantities of proteases into the media, this is important in terms of the ability to recover protease enzymes produced as a result of expression of Vibrio protease genes in these non-secreting hosts.

Also contemplated for use herein are mutants and hybrids of the foregoing proteases which substantially retain the performance characteristics thereof, i.e., which satisfy the cold water specific activity, Delft specific activity, optimum proteolytic activity as a function of pH, pH stability and also preferably the chlorine-releasing oxidizing agent stability tests set forth above. As used herein, the term "mutant" refers to a protease in which a change is present in the amino acid sequence as compared with wild type or parent enzymes. "Hybrid" refers to genetically engineered proteases which combine amino acid sequences from two or more parent enzymes and exhibit characteristics common to both.

Techniques for the preparation of mutant proteases are well known to those skilled in the art and include exposure of a microorganism to radiation or chemicals and site-directed mutagenesis. Mutagenesis by radiation or chemicals is essentially a random process and can require a tedious selection and screening to identify microorganisms which produce enzymes having the desired characteristics. Preferred mutant enzymes for the purposes of this invention are thus prepared by site directed mutagenesis. This procedure involves modification of the enzyme gene such that substitutions, deletions and/or insertions of at least one amino acid at a predetermined site are produced in the protease enzyme. Techniques for site directed mutagenesis are well known to those skilled in the art, and are described, for example, in European Published Patent Application No. 0 130 756 and PCT Published Patent Application No. W087/04461, the entirety of which are hereby incorporated by reference and relied on in their entirety.

In one such procedure, known as cassette mutagenesis, silent restriction sites are introduced into the protease gene, closely flanking the target codon or codons. Duplex synthetic oligonucleotide cassettes are then ligated into the gap between the restriction sites. The cassettes are engineered to restore the coding sequence in the gap and to introduce an altered codon at the target codon.

The use of such procedures on the parent Vibrio proteases may be desirable in order to improve the pH or temperature stability (or activity) properties of the wild type or parent protease, its stability to oxidizing agents, activity profile, etc. For example, the methionine, histidine, cysteine or tryptophan residues in or around the active site of the protease may be replaced in order to improve stability to chemical oxidation, as suggested in Estell et al., *J. Biological Chemistry*, Vol. 260, No. 11, pages 6518–1521 (1985).

Hybrids of the parent or wild type proteases may likewise be prepared by known protein engineering procedures analagous to the above-discussed cassette mutagenesis procedure by ligating a region of the gene of one parent enzyme (which need not be derived from Vibrio) into the gene of a second parent enzyme. The preparation of such hybrids may be desirable for example, in order to combine the high activity and hypochlorite stability properties of the Vibrio proteases with e.g., the alkaline stability properties of the Bacillus alkaline proteases.

The proteases of this invention may be combined with detergents, builders, bleaching agents and other conventional ingredients to produce a variety of novel cleaning compositions useful in the laundry and other cleaning arts, such as for example laundry detergents (both powdered and liquid), laundry pre-soaks, bleaches, automatic dishwashing detergents (both liquid and powdered), and household cleaners. In addition, the Vibrio extracellular proteases may also be employed in the cleaning of contact lenses and protein fouled ultrafiltration and other membranes by contacting such articles with solutions, e.g., aqueous solutions, of the Vibrio proteases.

A preferred use of the proteases of this invention is in the formulation of protease-containing cleaning compositions such as laundry detergents, laundry pre-soaks, bleaches and automatic dishwashing detergents. The composition of such products is not critical to this invention, and the same may readily be prepared by combining an effective amount of a Vibrio protease, preferably vibriolysin, with the conventional components of such compositions in their art recognized amounts.

Laundry detergents will typically contain, in addition to the protease of this invention, at least one detergent, at least one builder, and other optional ingredients such as bleaching agents, enzyme stabilizers, soil suspending and anti-redeposition agents, lipases and amylases, optical brighteners, softening agents, buffers, suds depression agents, coloring agents and perfumes. Those skilled in the art are well aware of such ingredients and any such materials as are commonly employed in detergent formulations may be present in the compositions of this invention.

By way of illustration but not of limitation, useful detergents include the anionic and nonionic surfactants and the water soluble soaps. The anionic surfactants include the water-soluble salts of alkyl benzene sulfonates, alkyl sulfates, alkyl polyethoxy ether sulfates, paraffin sulfonates, alpha-olefin sulfonates, alpha-sulfocarboxylates and their esters, alkyl glyceryl ether sulfonates, fatty acid monoglyceride sulfates and sulfonates, alkyl phenol polyethoxy ether sulfates, 2-acyloxy-alkane-1-sulfonates, and beta-alkyloxy alkane sulfonates.

Representative alkyl benzene sulfonates include those having from about 9 to 15 carbon atoms in a linear or branched alkyl chain, more especially about 11 to about 13 carbon atoms. Suitable alkyl sulfates have about 10 to about 22 carbon atoms in the alkyl chain, more especially from about 12 to about 18 carbon atoms. Suitable alkyl polyethoxy ether sulfates have about 10 to 18 carbon atoms in the alkyl chain and have an average of about 1 to 12 —$CH_2CH_2O$—groups per molecule, especially about 10 to about 16 carbon atoms in the alkyl chain and an average of about 1 to about 6 —$CH_2CH_2O$—groups per molecule.

The paraffin sulfonates are essentially linear compounds containing from about 8 to about 24 carbon atoms, more especially from about 14 to about 18 carbon atoms. Suitable alpha-olefin sulfonates have about 10 to about 24 carbon atoms, more especially about 14 to about 16 carbon atoms; alpha-olefin sulfonates can be made by reaction with sulfur trioxide, followed by neutralization under conditions such that any sulfones present are hydrolyzed to the corresponding hydroxy alkane sulfonates. Suitable alpha-sulfocarboxylates contain from about 6 to 20 carbon atoms; included herein are not only the salts of alpha-sulfonated fatty acids but also their esters made from alcohols containing about 1 to about 14 carbon atoms.

Suitable alkyl glyceryl ether sulfates are ethers of alcohols having about 10 to about 18 carbon atoms, more especially those derived from coconut oil and tallow. Suitable alkyl phenol polyethoxy ether sulfates have about 8 to about 12 carbon atoms in the alkyl chain and an average of about 1 to about 6 —$CH_2CH_2O$—groups per molecule. Suitable 2-acyloxyalkane-1-sulfonates contain from about 2 to about 9 carbon atoms in the acyl group and about 9 to 23 carbon atoms in the alkane moiety. Suitable beta-alkyloxy alkane sulfonates contain about 1 to about 3 carbon atoms in the alkyl group and about 8 to about 20 carbon atoms in the alkane moiety.

The alkyl chains of the foregoing anionic surfactants can be derived from natural sources such as coconut oil or tallow, or can be made synthetically as for example by using the Ziegler or Oxo processes. Water-solubility can be achieved by using alkali metal, ammonium, or alkanol-ammonium cations; sodium is preferred.

Suitable soaps contain about 8 to about 18 carbon atoms, more especially about 12 to about 18 carbon atoms. Soaps can be made by direct saponification of natural fats and oils such as coconut oil, tallow and palm oil, or by the neutralization of free fatty acids obtained from either natural or synthetic sources. The soap cation can be alkali metal, ammonium or alkanol-ammonium; sodium is preferred.

The nonionic surfactants are water-soluble ethoxylated materials of HLB 11.5–17.0 and include (but are not limited to) $C_{10}$–$C_{20}$ primary and secondary alcohol ethoxylates and $C_6$–$C_{10}$ alkylphenol ethoxylates. $C_{14}$–$C_{18}$ linear primary alcohols condensed with from 7 to 30 moles of ethylene oxide per mole of alcohol are preferred, examples being $C_{14}$–$C_{15}$ $(EO)_7$, $C_{16}$–$C_{18}$ (EO)25 and especially $C_{16}$–$C_{18}$ $(EO)_{11}$.

Other types of surfactants such as ampholytic and zwitterionic surfactants may be employed if desired. In the preferred embodiment, cationic surfactants are preferably not employed since they have been found to have a deleterious effect on protease stability.

Representative builders include the alkali metal carbonates, borates, phosphates, polyphosphates, bicarbonates, and silicates. Specific examples of such salts include the sodium and potassium tetraborates, bicarbonates, carbonates, triphosphates, pyrophosphates, pentapolyphosphates and hexametaphosphates. Sulfates are usually also present. Zeolites and other sodium aluminosilicates may also be employed for this purpose.

Examples of suitable organic builder salts include:

(1) water-soluble amino polyacetates, e.g., sodium and potassium ethylenediaminetetraacetates, nitrilotriacetates, N-(2-hydroxyethyl) nitrilodiacetates and diethylene triamine pentaacetates;

(2) water-soluble salts of phytic acid, e.g., sodium and potassium phytates;

(3) water-soluble polyphosphonates, including sodium, potassium and lithium salts of methylenediphosphonic acid and the like and aminopolymethylene phosphonates such as ethylenediaminetetramethylenephosphonate and diethylene triaminepentamethylene phosphate;

(4) water-soluble polycarboxylates such as the salts of lactic acid, succinic acid, malonic acid, maleic acid, citric acid, carboxymethylsuccinic acid, 2-oxa-1,1,3-propane tricarboxylic acid, 1,1,2,2-ethane tetracarboxylic acid, mellitic acid and pyromellitic acid.

Mixtures of organic and/or inorganic builders are frequently employed.

Bleaching agents include hydrogen peroxide, sodium perborate, sodium percarbonate, other perhydrates, peracids, chlorine-releasing oxidizing agents such as sodium hypochlorite, chlorocyanuric acid, and compounds such as 1,12-dodecane dipercarboxylic acid and magnesium peroxyphthalate. Where a persalt bleaching agent is employed, the composition will also contain an initiator such as acylobenzene sulfonate.

Suds controlling agents include suds boosting or suds stabilising agents such as mono- or di-ethanolamides of fatty acids. More often in modern detergent compositions, suds depressing agents are required. Soaps, especially those having 18 carbon atoms, or the corresponding fatty acids, can act as effective suds depressors if included in the anionic surfactant component of the present compositions. About 1% to about 4% of such soap is effective as a suds suppressor. Preferred suds suppressors comprise silicones.

Soil suspending agents include the water soluble salts of carboxymethylcellulose, carboxyhydroxymethyl cellulose, polyethylene glycols of molecular weight of from about 400 to 10,000 and copolymers of methylvinylether and maleic anhydride or acid. Such materials are usually employed in amounts up to about 10% by weight.

Optical brighteners typically include the derivatives of sulfonated triazinyl diamino stilbene.

A typical laundry detergent will include the foregoing components in amounts as follows:

Surfactant: from about 5–60 weight percent
Builder: up to about 60 weight percent
Bleaching agent: up to about 30 weight percent
Soil-suspending agent: up to about 0.1–5 weight percent
Optical brighteners: up to about 3 weight percent Other ingredients: minor amounts, e.g., less than about 5 weight percent Further details concerning the formulation of laundry detergents may be obtained from U.S. Pat. Nos. 3,553,139; 3,697,451; 3,748,233; 4,287,101; 4,515,702; and 4,692,260; European Published Patent Application No. 0 120 528; and *Innovations in Biotechnology,* edited by E. H. Houwink and R. R. van deer Meer, pages 31–52 (Elsevier Science Publishers, Amsterdam, 1984), the entirety of which are hereby incorporated by reference and relied on in their entirety.

Automatic dishwasher detergents frequently contain, in addition to protease and at least one detergent of the types described above, a chlorine-releasing bleaching agent such as sodium hypochlorite or an isocyanurate salt and other conventional ingredients such as builders, etc. Further details concerning the preparation of such products may be obtained from U.S. Pat. Nos. 3,799,879; 4,162,987; and 4,390,441, the entirety of which are hereby incorporated by reference and relied on in their entirety.

Preferred bleaches in accordance with the present invention are of the powdered type and contain, e.g., protease, builders, surfactant, and bleaching agents of the types set forth hereinabove.

Where desired, the proteases of this invention ma be used in combination with other proteases, such as for example subtilisin Carlsberg, in any of the foregoing types of cleaning compositions in order to take advantage of the different activity profiles and/or substrate activities of each enzyme.

In addition to the foregoing specifically illustrated utilities, the Vibrio proteases of this insertion may also be formulated into various other types of protease-containing cleaning compositions such as are known to those skilled in the art.

The following examples serve to give specific illustration of the practice of this invention, but they are not intended in any way to act to limit the scope of the invention.

In each of the examples which follow, the Vibrio protease comprised vibriolysin. Subtilisin Carlsberg and thermolysin were used as references for comparison. The assays used for the purposes of determining protease activity were the above-described azocasein and Delft assays. In some cases, the activity of subtilisin was determined by measuring peptidase activity. This assay measures the increase in absorbance at 410 mm due to the release of p-nitroaniline from succinyl-L-alanyl-L-alanyl-L-prolyl-L-phenylalanyl p-nitroanilide (sAAPFpN) as described in Del Mar, E. G., et al, *Anal. Biochem.,* Vol. 99, page 316 (1979). The reaction mixtures used for this assay contained in a final volume of 1.0 ml, 0.001M sAAPFpN, 50 mM Tris buffer, pH 8.5, and a suitable amount of protease.

The vibriolysin used in these examples was isolated from *Vibro proteolyticus* (ATCC 53559) as follows:

1. Preparation of *Vibrio Proteolyticus* Seed Culture

A. Preparation—100 ml seed medium (as described for the culture medium set forth below) is contained in a 500 ml indented Erlenmeyer flask and autoclaved 20 minutes at 121° C.

B. Inoculation—A single −70° C. ampoule of organism is thawed under tap water, then aseptically transferred to the seed flask.

C. Incubation—The inoculated flask is incubated 18 hours at 250 rpm/27° C.

D. Growth measured at 640 mm. is between an optical density of 4.0 to 6.0; broth pH is approximately 8.0.

2. Enlarged Fermentation—1.0 liter volume in a 1.5 liter fermenter

A. A culture medium comprising the following ingredients (grams/liter) are added to the vessel:

Soya flour: 40 grams/liter
Sea salts: 2 grams/liter
$Na_2SO_4$: 25 grams/liter
$KH_2PO_4$: 4 grams/liter
Trace element solution: 10 ml/liter
Polyglycol P-2000 (DOW): 0.4 ml/liter The trace element solution comprises (grams per liter) the following:

$ZnSO_4 \cdot 7H_2O$: 18.29 grams/liter
$MnCL_2 \cdot 4H_2O$: 18.86 grams/liter
$CaSO_4 \cdot 2H_2O$: 0.91 grams/liter
$H_3BO_3$: 0.07 grams/liter
$Na_2MoO_4 \cdot 2H_2O$: 0.4 grams/liter pH is unadjusted prior to sterilization; it should be nearly pH 7.0. A 1.0 liter vessel, if sterilized in an autoclave, should be sterilized 45 min. at a temperature of 121° C.

B. Inoculation (1) First set and double check operating parameters:
a. pH to 8.6 with 6N NaOH
b. temperature=27° C.
c. RPM=1000
d. dissolved oxygen readout to 100% at 1.0-LPM air.
(2) Inoculate with 10 ml seed broth.

C. Operation (1) Maintain aforementioned parameters.
(2) Dissolved oxygen will drop to about 75–80% at peak demand.
(3) Monitor the following:
a. Optical Density—read at 640 mm absorbance. Peaks at about 10–12 O.D. in about 12–14 hours.
b. Production of vibriolysin protease—to about 18 azocasein units/ml.

3. Harvest and Purification of Vibriolysin

At about 10–14 hours into the fermentation the product protease reaches titers of approximately 0.1 to 0.2 grams/liter as measured by the azocasein assay. The broth is harvested before the cells lyse to an advanced stage (about 10–25%) and is then centrifuged to separate the cell portion.

The fermentation broth is then brought to 0.5% with respect to $Na_2CO_3$ and the pH adjusted to pH 11.6 by addition of 1 N NaOH. The resulting solution is then incubated for two hours at 25° C., concentrated with an Amicon SY10 filter, followed by washing with deionized water and thereafter 10 mM Tris-HCl, pH 8.0, until the conductivity and pH of the retentate is equal to that of the Tris buffer. The retentate is next applied to a column of quaternary ammonium cellulose (QA-52, Whatman Ltd., Maidstone, Kent, England) previously equilibrated with 10 mM Tris buffer, pH 8.0, and vibriolysin is eluted from the column, after washing, with a linear gradient of 0–0.5 M NaCl in 1 liter total volume of 10 mM Tris-HCl, pH 8.0. The most active fractions are pooled and stored as an ammonium sulfate suspension at 4° C. A summary of the purification is shown in TABLE I below:

TABLE I

| Step | Vol. (ml) | Total Units | Total Protein (mg) | Sp. Act. | % Rec. | Pur. Factor |
|---|---|---|---|---|---|---|
| Crude broth | 700 | 46,900 | 3,290 | 14 | 100 | 1 |
| Treated concentrate | 250 | 48,125 | 600 | 80 | 103 | 6 |
| QA52 cellulose chromatography | 131 | 18,602 | 138 | 135 | 40 | 9 |

EXAMPLE 1

The specific activity of purified vibriolysin was determined on various protein substrates and compared to the most widely used detergent protease, subtilisin Carlsberg. Proteases were assayed by the Delft assay (British Patent No. 1,353,317) which measures trichloroacetic acid-soluble peptides released from casein during incubation with enzyme at 40° C., pH 8.5. Vibriolysin exhibited a specific activity of 14,795 Delft units (DU) per mg as compared to 4,963 DU/mg for subtilisin Carlsberg (Sigma Chemical Co.; greater than 95% pure).

Using the azocasein assay (40° C., pH 8.1), and a modified azocasein assay wherein azoalbumin was substituted for azocasein (40° C., pH 8.1), the specific activities of vibriolysin and subtilisin using azocasein and azoalbumin as substrates were compared. The results of these experiments are set forth in TABLE II below:

TABLE II

| Enzyme | Specific Activity (azocasein units/mg) | (azoalbumin units/mg |
|---|---|---|
| Vibrolysin | 122 | 193 |
| Subtilisin | 33 | 26 |

These results indicate that vibriolysin exhibits a 3-fold higher specific activity according to the Delft assay as compared with subtilisin Carlsberg, and a 3-fold greater activity with azocasein and a 7-fold greater activity with azoalbumin than subtilisin Carlsberg.

EXAMPLE 2

Using the azocasein assay (pH 7.4, 37° C.), the specific activities of subtilisin Carlsberg (Sigma Chemical Co.) and vibriolysin were assessed at pH values ranging from 6 to 11.5 at 25, 40 and 50° C.

Figure 3:
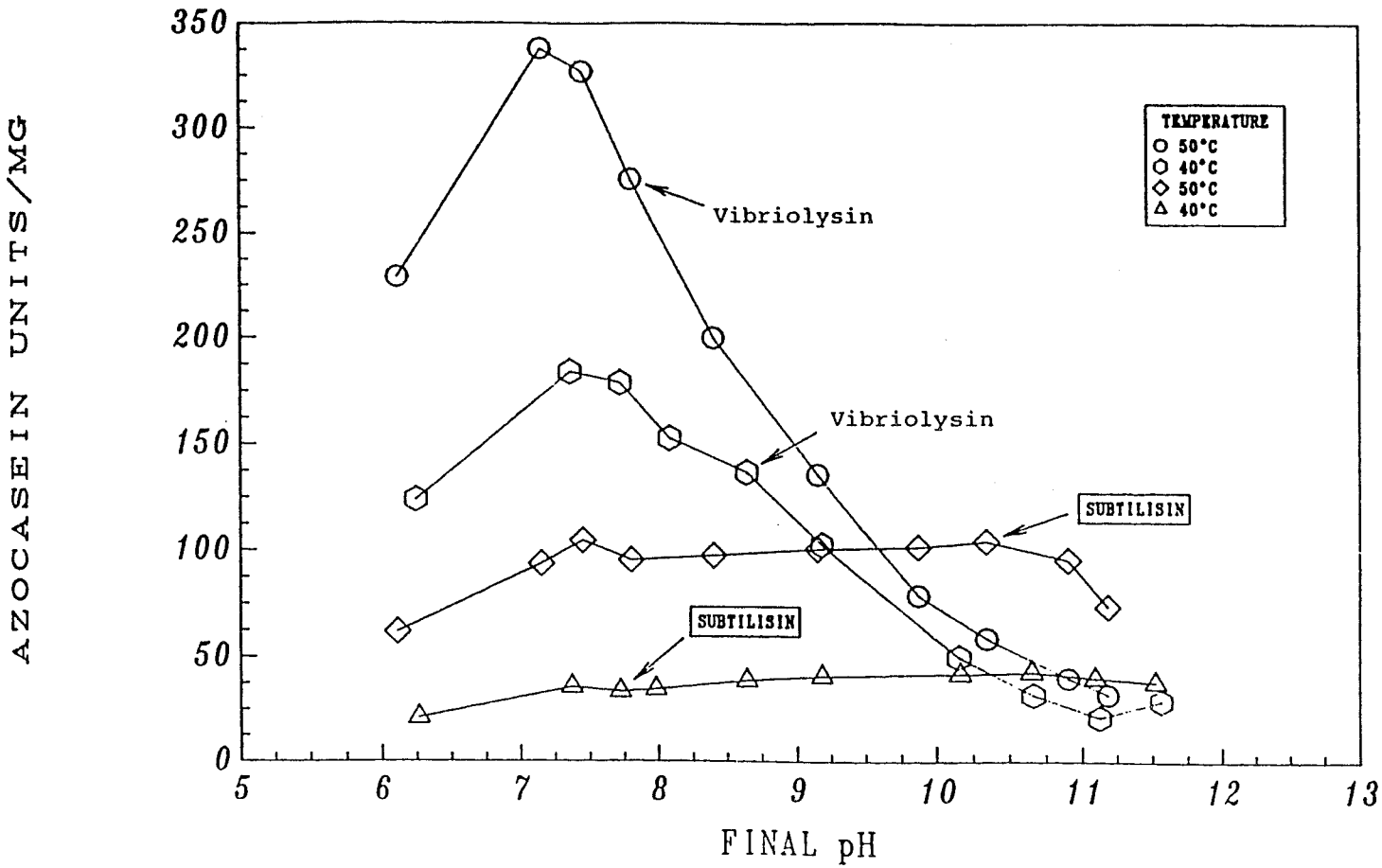
FIG. 3 is a graphical comparison of the specific activities of vibriolysin and subtilisin Carlsberg as a function of pH at 40° and 50° C.

The buffers used during each of these assays were as follows:

pH 6.2: 50 mM MES
pH 7.2–8.6: 50 mM Tris
pH 9.2: 25 mM borate
pH 9.9–10.7: 50 mM CAPS
pH 10.9–11.6: 50 mM $Na_2CO_3$ The results are these experiments are plotted in FIGS. 2 and 3.

As can be seen from these graphs, subtilisin possesses a broad pH activity profile; by comparison, vibriolysin is most active at pH 7.4–7.6 (25° and 40° C.). At 25° C., the specific activity of vibriolysin is 2–4 times greater than subtilisin between pH 6 to about pH 10.2 (see FIG. 2). At 40° C., the specific activity of vibriolysin is greater than subtilisin from pH 6 to pH 10.2, whereas subtilisin is more active at pH values greater than 10.2 (FIG. 3). The data indicate that between pH 6–10.2 vibriolysin is 1.2 to 6.1-fold more active than subtilisin at 40° C. Similarly at 50° C., vibriolysin has a higher specific activity (1.4–3.7-fold) than subtilisin at lower pH values (pH 6–9).

Practically speaking, it is significant to note that vibriolysin is 1.4 to 2-fold more active at 40° C. at pH 6–9 than subtilisin is at these pH values at 50° C. (FIG. 3). Thus, potentially one could get the desired augmentation of detergency with a warm water wash (40° C.) using a vibriolysin-supplemented detergent that would require a hot water wash (50°–55° C.) with a subtilisin-supplemented laundry product. This is important due to the trend to reduce wash temperatures. Further, it should be noted that the pH of wash water containing liquid laundry products ranges from pH 7.0 to pH 9.0, the range that vibriolysin is most active (FIG. 3).

EXAMPLE 3

Figure 4:
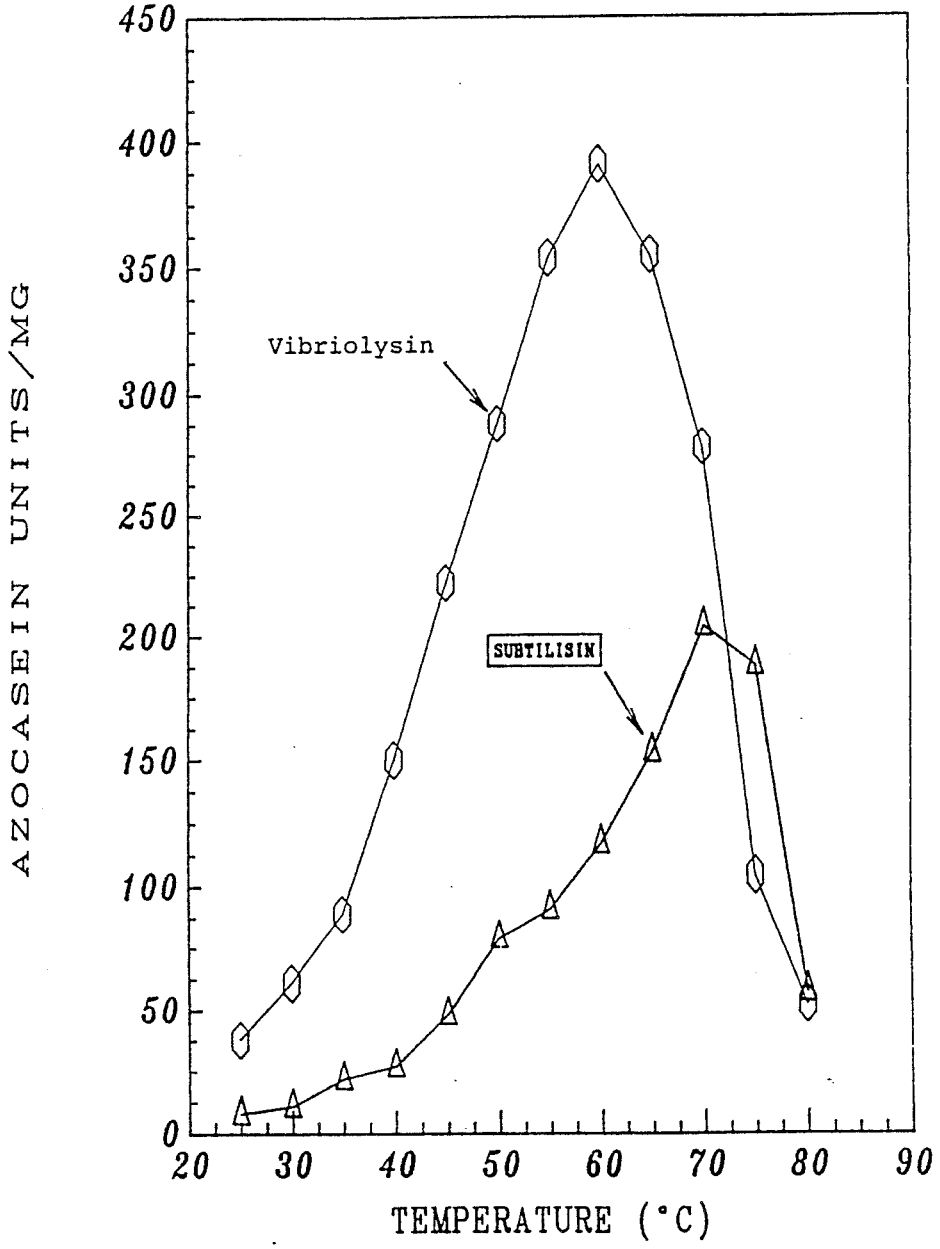
FIG. 4 is a graphical comparison of the specific activities of vibriolysin and subtilisin Carlsberg as a function of temperature.

Using the azocasein assay (pH 7.4, 37° C.) the specific activities of vibriolysin and subtilisin Carlsberg (Sigma Chemical Co.) were determined as a function of temperature by adding enzyme to reaction solutions pre-equilibrated at various temperatures. The as prepared test solutions had a pH of 8.2 (25° C.) before heating. The results of these experiments are plotted in FIG. 4. These data clearly demonstrate the superiority of vibriolysin under cool (25° C.) and warm (40° C.) conditions. The results of this example suggest that vibriolysin is a superior candidate for use in cool and warm water washing formulations, as compared to the most widely used detergent protease, subtilisin Carlsberg.

EXAMPLE 4

Figure 5:
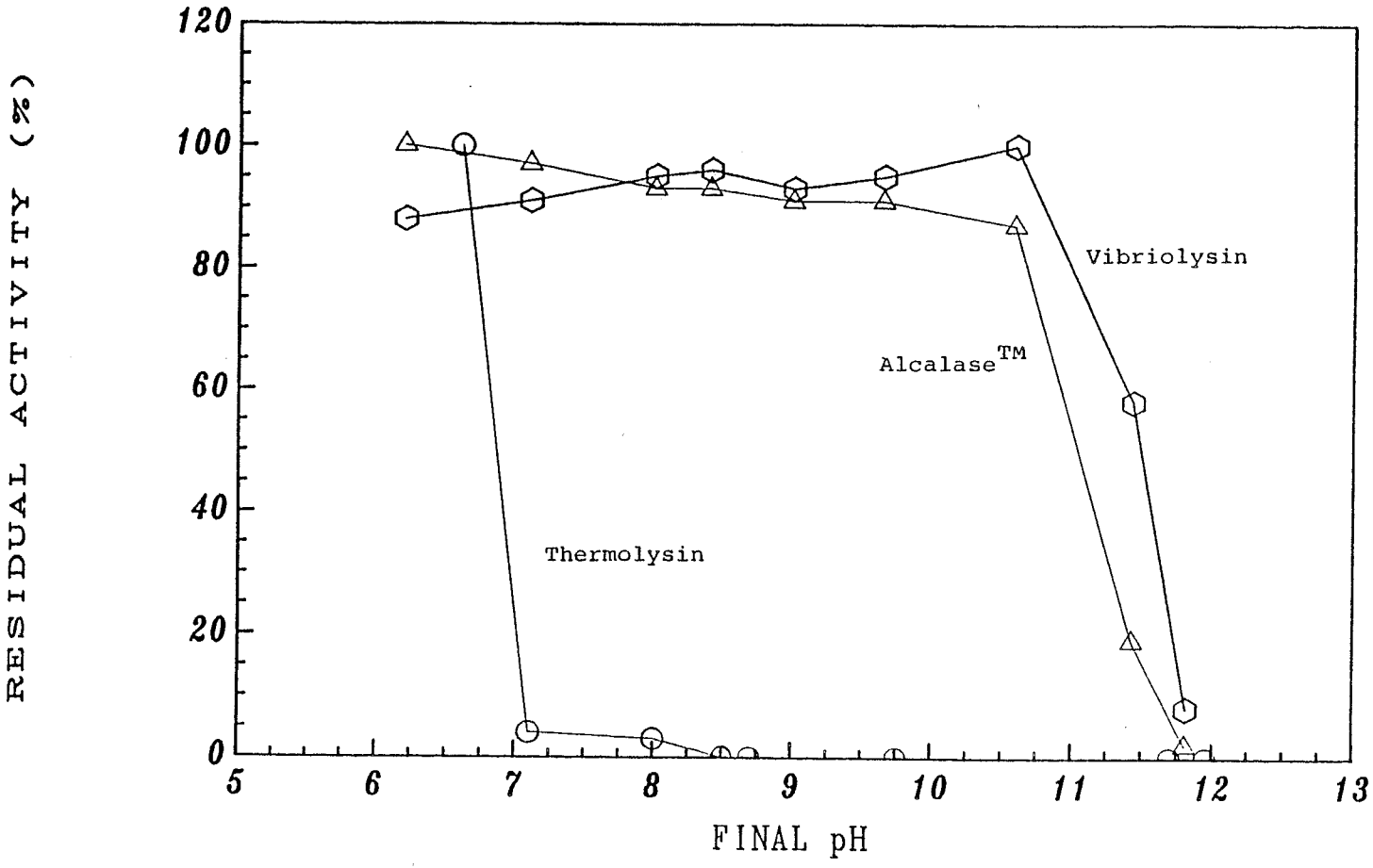
FIG. 5 is a graphical comparison illustrating the pH stability of vibriolysin, Alcalase TM (subtilisin Carlsberg) and thermolysin over the pH range of 6 to 12.

The pH stabilities (% residual activity) of vibriolysin, subtilisin Carlsberg (Alcalase TM, Novo Laboratories, Wilton, Conn.) and thermolysin (Sigma Chemical Co.) were determined by measuring the percent residual activity of each enzyme, using the azocasein assay (pH 7.4, 37° C.), after incubation for 24 hours at 25° C. in a series of 0.25% sodium tripolyphosphate buffer solutions having a pH between 6.5 to 12.0. The results of these experiments are plotted in FIG. 5. As can be seen therefrom, vibriolysin is more alkaline stable than Alcalase TM, retaining, for example, about 50% of its activity at pH 11.4 as compared to only about 20% for Alcalase TM at this pH. This result is particularly surprising since vibriolysin is a neutral protease and thus would be expected to be less stable at alkaline pH than the alkaline protease Alcalasev. This unexpected alkaline stability of vibriolysin should be contrasted with that of thermolysin, another common neutral protease, which is immediately inactivated at alkaline pH.

EXAMPLE 5

The thermal stabilities of vibriolysin and ALCALASE TM (subtilisin Carlsberg) were compared by measuring the percent residual activity of each protease over time after incubation of equal amounts of each enzyme in temperature controlled 25 mM borate buffer (pH 9.0) test solutions, preincubated to temperatures ranging from 40°–70° C. During the incubation, aliquots were periodically removed from the different temperature test solutions, cooled on ice, and then the activity of the protease measured by the azocasein assay (pH 7.4, 37° C.).

Figure 6:
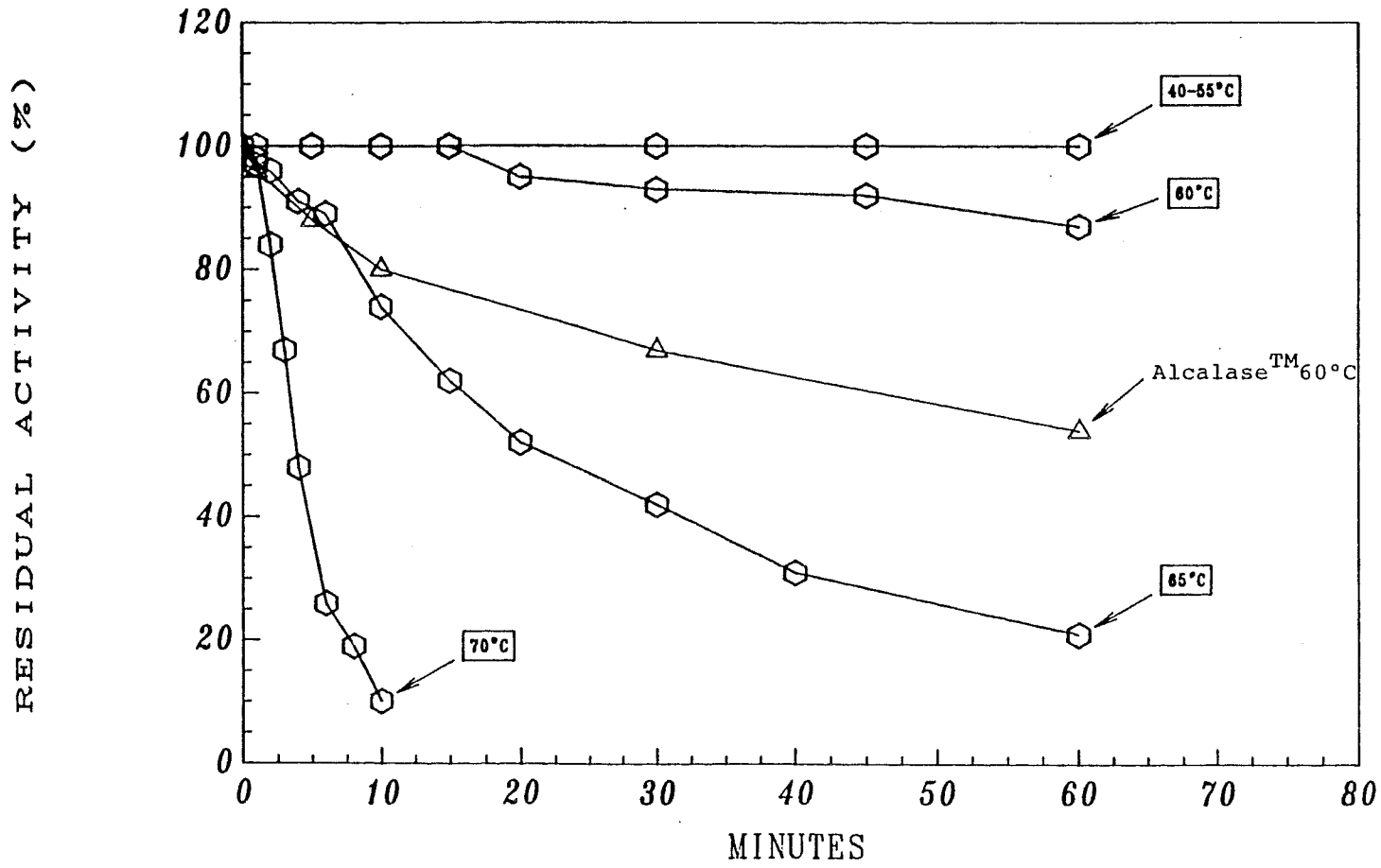
FIG. 6 is a graphical comparison illustrating the thermal stability of vibriolysin and Alcalase$\pi$ at various temperatures.

The results of these experiments are plotted in FIG. 6. As can be seen therefrom, vibriolysin is substantially more stable at 60° C. than Alcalase TM.

EXAMPLE 6

The stabilities of vibriolysin, Alcalase TM and thermolysin to sodium hypochlorite, the active ingredient in Chlorox TM (Chlorox Corp.) and other chlorine-containing bleaches, were compared by adding equal amounts of enzyme to temperature equilibrated (either 40° C., 45° C. or 50° C.), 25 mM borate buffer (pH 9.0) test solutions containing 0.026% by weight sodium hypochlorite. Samples of protease were periodically withdrawn from each test solution and immediately chilled in ice-cold water. Residual activities were then determined using the azocasein assay (pH 7.4, 37° C.). The results of these experiments are set forth in FIG. 7.

Figure 7:
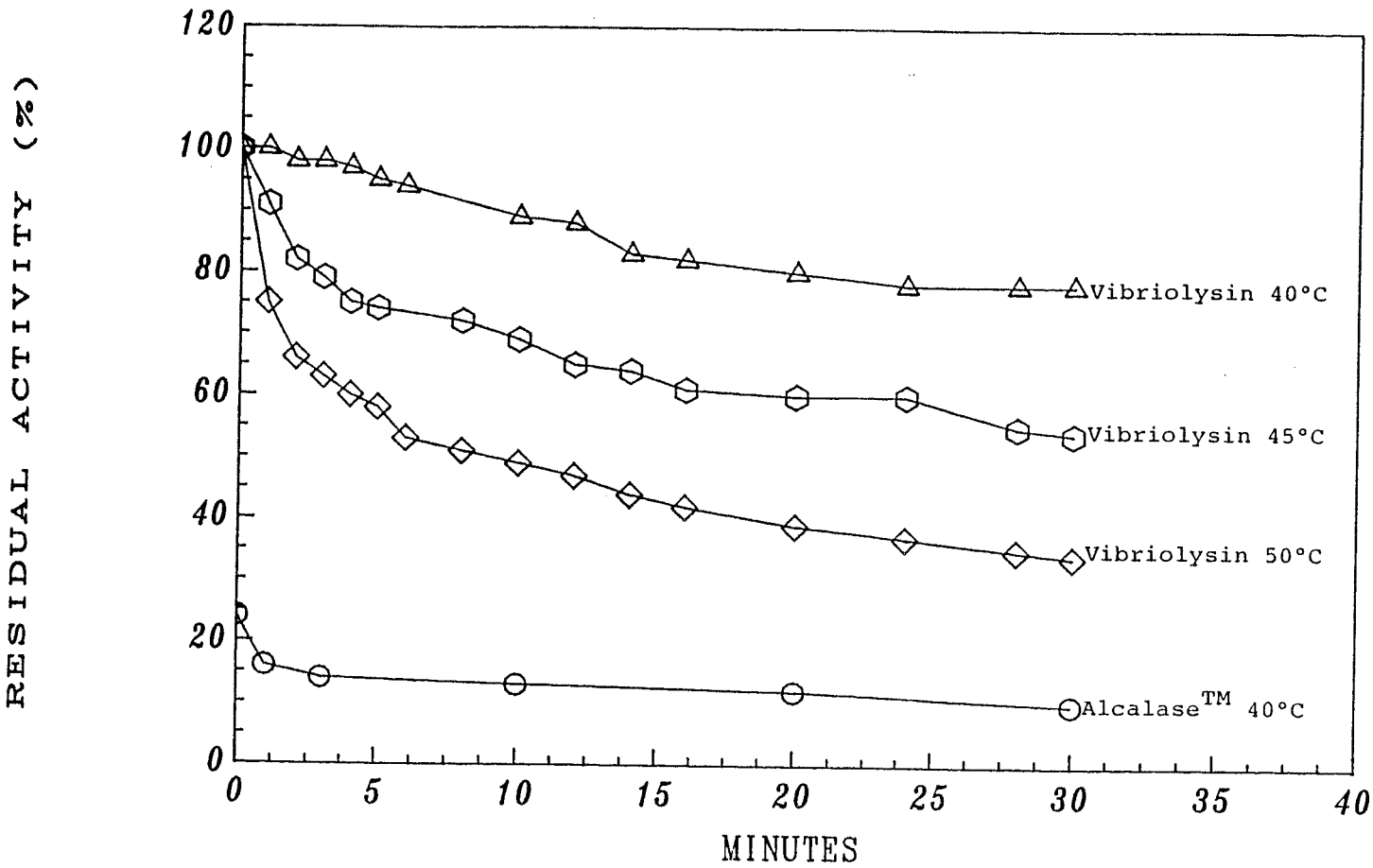
FIG. 7 is a graphical comparison illustrating the stability of vibriolysin and Alcalase TM (subtilisin Carlsberg) to sodium hypochlorite at various temperatures.

As can be seen from FIG. 7, vibriolysin is uniquely stable to sodium hypochlorite, retaining greater than 90% of its activity when incubated for 10 minutes with sodium hypochlorite at 40° C. In contrast, Alcalase TM retained only about 4% of its activity after 5 minutes of incubation in sodium hypochlorite at this temperature.

By way of further comparison, the procedures of this example were repeated using thermolysin as the protease. In contrast to vibriolysin, thermolysin was immediately deactivated upon addition to the sodium hypochloriteborate buffer solution.

EXAMPLE 7

Figure 8:
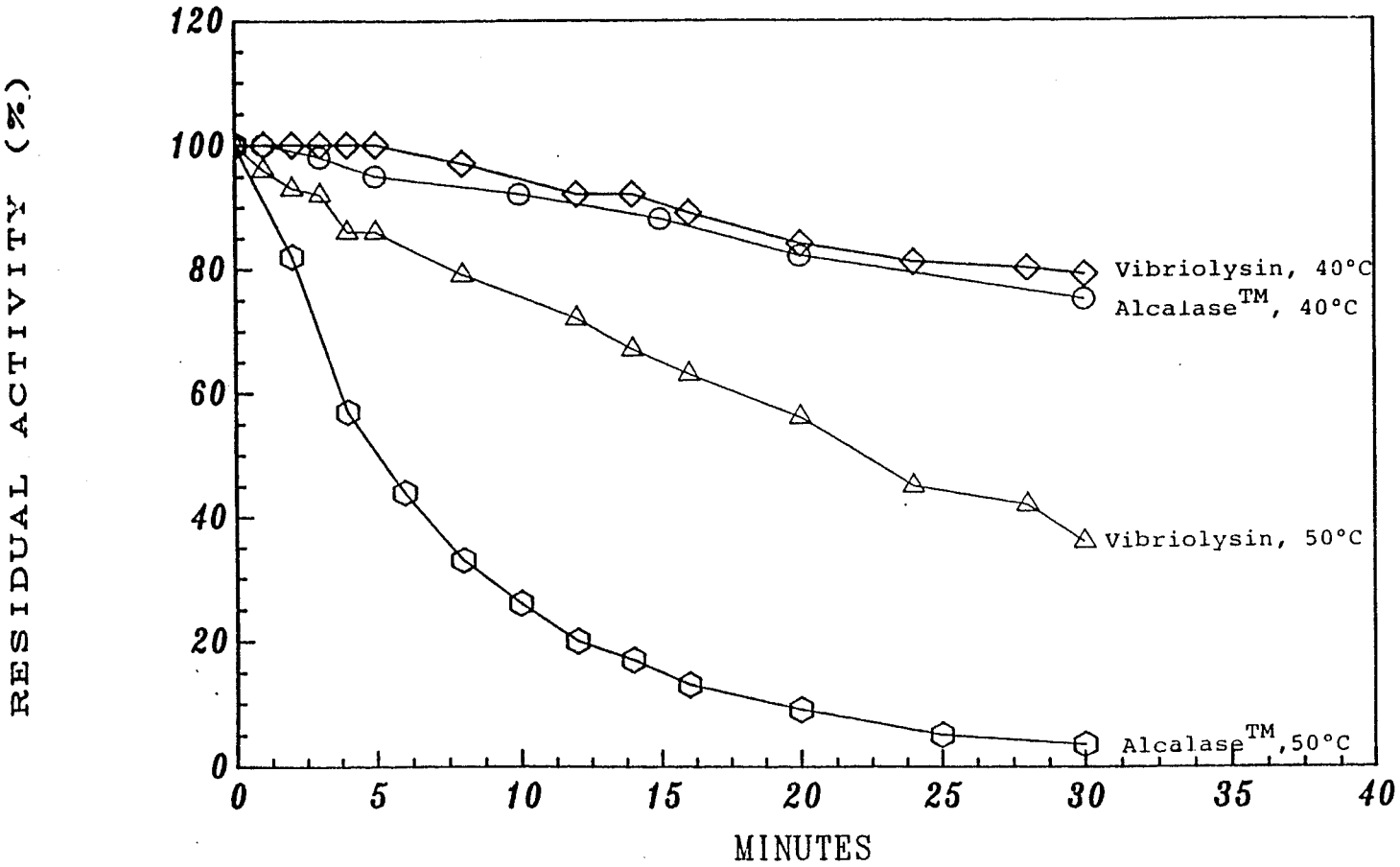
FIG. 8 is a graphical comparison illustrating the stability of vibriolysin and Alcalastem TM (subtilisin Carlsberg) to hydrogen peroxide at various temperatures.

Following the procedures of Example 6, the stabilities of vibriolysin and Alcalase TM to hydrogen peroxide were compared. The incubation solutions used in these experiments comprised a 0.25 mM borate buffer (pH 9.0) solution containing 5% weight/volume hydrogen peroxide. The results are summarized in FIG. 8. As can be seen therefrom, vibriolysin is significantly more stable to hydrogen peroxide at 50° C. than is Alcalase TM.

EXAMPLE 8

The stabilities of vibriolysin and Alcalase TM to dodecylbenzene sulfonic acid (LAS), the anionic surfactant most widely employed in laundry detergent formulations, were compared by incubating equal amounts of each protease in 25 mM borate buffer solutions (pH 9.2) containing various amounts of LAS. Residual activities at the end of the incubation period were determined by the azocasein assay (pH 7.4, 37° C.). The test conditions and results of these experiments are set forth in TABLE VI below:

TABLE VI

| Temperature | Time | % LAS | % Residual Activity of: Vibriolysin | ALCALASE TM |
|---|---|---|---|---|
| 25° C. | 24 hrs. | None | 100 | 100 |
| 25° C. | 24 hrs. | 1 | 99 | 61 |
| 25° C. | 24 hrs. | 2 | 92 | 66 |
| 25° C. | 24 hrs. | 5 | 61 | 59 |
| 25° C. | 24 hrs. | 10 | 35 | 50 |
| 55° C. | 1 hr. | 10[a] | 19 | 0 |

[a]pH = 9.0

EXAMPLE 9

The half-lives of vibriolysin, Alcalase TM and thermolysin in a series of commercial liquid laundry detergents were determined by adding equal amounts of each enzyme to samples of undiluted detergent, preincubated at 60° C. The liquid laundry detergents employed in these experiments were Tide TM (Proctor & Gamble), Cheer TM (Proctor & Gamble), All TM (Lever Bros.), Wisk TM (Lever Bros.), Arm & Hammer TM (Church & Dwight) and Surf TM (Lever Bros.). Prior to addition of protease, the Tide TM and Cheer TM samples, which contain protease as formulated, were heated at 60° C. for 60 minutes to completely inactivate the enzyme originally present therein. Deactivation was confirmed by the peptidase assay. Following protease addition to the undiluted preincubated detergent samples, aliquots were periodically removed, diluted into ice-cold deionized water and assayed by either the azocasein assay (vibriolysin, thermolysin) or peptidase assay (Alcalase TM). The results of these experiments are summarized in TABLE VII below:

TABLE VII

| Detergent | pH[a] | Half-Life (min.) of: Vibriolysin | ALCALASE TM | Thermolysin |
|---|---|---|---|---|
| Cheer | 8.2 | 22 | 9 | 6.3 |
| Tide | 8.4 | 2 | 10 | — |
| A & H | 10.8 | 12 | 7 | 5 |
| Surf | 9.1 | 7.5 | 3 | — |
| Wisk | 11.1 | 2.5 | 1.3 | — |

[a]pH of undiluted product at 25° C.

The results of these experiments demonstrate that with the exception of Tide TM which contains a cationic surfactant deleterious to vibriolysin activity, vibriolysin is at least two-fold more stable than Alcalase TM in commercial heavy duty liquid laundry detergents.

What is claimed is:

1. A cleaning composition comprising a builder, a detergent and optionally a bleaching agent, and in an amount effective to enhance removal of protein-containing materials, a protease selected from the group consisting of:

(a) an extracellular neutral protease produced by cultivation of *Vibrio proteolyticus* (ATCC 53559) characterized by the following properties:
  i. a cool water (25° C.) specific activity of at least 30 azocasein units/mg of protease at pH 8.2,
  ii. a specific activity (Delft method) of at least 3,000 Delft units/mg of protease,
  iii. an optimum proteolytic activity at a pH in the range of from about pH 6.5 to pH 9.0, and
  iv. a stable activity over a pH range of pH 6.5 to pH 11.0;

(b) a protease expressed by recombinant host cells which have been transformed or transfected with an expression vector for said protease (a); and (c) mutants and hybrids of proteases (a) and (b) which are characterized by the properties (i) to (iv).

2. The cleaning composition of claim 1, wherein said protease is stable in the presence of chlorine-releasing oxidizing agents.

3. The cleaning composition of claim 1, wherein said protease has a DNA sequence as illustrated in FIG. 1.

4. The cleaning composition of claim 1 or 3, wherein said cleaning composition comprises at least one detergent, at least one builder and said protease.

5. The cleaning composition of claim 5, wherein said cleaning composition is a laundry detergent composition.

6. The cleaning composition of claim 5, wherein said laundry detergent composition contains from about 5 to about 60 percent by weight of said at least one detergent; up to about 60 percent by weight of said at least one builder; and from about 0.1 to about 5 percent by weight of said protease.

7. The cleaning composition of claim 6, wherein said at least one detergent is selected from the group consisting of anionic surfactants, nonionic surfactants and mixtures thereof.

8. The cleaning composition of claim 4, wherein said cleaning composition is an automatic dishwashing composition.

9. The cleaning composition of claim 4, further comprising a bleaching agent.

10. The cleaning composition of claim 9, wherein said cleaning composition is a laundry detergent composition.

11. The cleaning composition of claim 10, wherein laundry detergent composition contains from about 5 to about 60 percent by weight of said at least one detergent; from about 0.10 to about 5 percent by weight of said protease; up to about 30 percent by weight of said bleaching agent; and up to about 60 percent by weight of a builder.

12. The cleaning composition of claim 9, wherein said cleaning composition is a laundry bleaching composition.

13. A method of cleaning comprising contacting an object to be cleaned with a cleaning effective amount of a solution containing the cleaning composition of claim 1.

14. The method of claim 13, wherein said object is a textile material.

15. The method of claim 13, wherein said object is dishware.

16. A method of removing protein-containing materials from a substrate comprising contacting said substrate with a solution containing an amount effective to enhance removal of said protein-containing materials of a protease selected from the group consisting of:

(a) an extracellular neutral protease produced by cultivation of *Vibrio proteolyticus* (ATCC 53559) characterized by the following properties:
   i. a cool water (25° C.) specific activity of at least 30 azocasein units/mg. of protease at pH 8.2,
   ii. a specific activity (Delft method) of at least 3,000 Delft units/mg of protease,
   iii. an optimum proteolytic activity at a pH in the range of form about pH 6.5 to pH 9.0 and
   iv. a stable activity over a pH range of pH 6.5 to pH 11.0;

(b) a protease expressed by recombinant host cells which have been transformed or transfected with an expression vector for said protease (a); and (c) mutants and hybrids of proteases (a) and (b) which are characterized by the properties (i) to (iv).

17. The method of claim 16, wherein said protease is stable in the presence of chlorine-releasing oxidizing agents.

18. The method of claim 16, wherein said protease has a DNA sequence as illustrated in FIG. 1.

* * * * *